US010989074B2

(12) United States Patent
Mitsui et al.

(10) Patent No.: US 10,989,074 B2
(45) Date of Patent: Apr. 27, 2021

(54) TURBINE EXHAUST HOOD

(71) Applicants: KABUSHIKI KAISHA TOSHIBA, Minato-ku (JP); Toshiba Energy Systems & Solutions Corporation, Kawasaki (JP)

(72) Inventors: Hiroaki Mitsui, Shinjuku (JP); Tsuguhisa Tashima, Yokohama (JP); Shogo Iwai, Ota (JP); Takahiro Ono, Ota (JP); Daichi Fukabori, Yokohama (JP)

(73) Assignees: KABUSHIKI KAISHA TOSHIBA, Minato-ku (JP); Toshiba Energy Systems & Solutions Corporation, Kawasaki (JP)

( * ) Notice: Subject to any disclaimer, the term of this patent is extended or adjusted under 35 U.S.C. 154(b) by 198 days.

(21) Appl. No.: 15/860,133

(22) Filed: Jan. 2, 2018

(65) Prior Publication Data

US 2018/0202320 A1 Jul. 19, 2018

(30) Foreign Application Priority Data

Jan. 17, 2017 (JP) ..... JP2017-005879

(51) Int. Cl.
*F01D 25/30* (2006.01)
*F01D 25/24* (2006.01)

(52) U.S. Cl.
CPC ..... *F01D 25/30* (2013.01); *F05D 2220/31* (2013.01); *F05D 2240/14* (2013.01); *F05D 2250/52* (2013.01); *F05D 2250/71* (2013.01)

(58) Field of Classification Search
CPC ..... F01D 25/30; F01D 25/24; F05D 2220/31; F05D 2240/14; F05D 2250/52; F05D 2250/71
See application file for complete search history.

(56) References Cited

U.S. PATENT DOCUMENTS 5,257,906 A * 11/1993 Gray ..... F01D 25/30 415/226
5,290,146 A * 3/1994 Erber ..... F01D 25/28 415/213.1

(Continued)

FOREIGN PATENT DOCUMENTS

JP S54-091503 6/1979
JP 3776580 5/2006

(Continued)

*Primary Examiner* — Igor Kershteyn
*Assistant Examiner* — Joshua R Beebe
(74) *Attorney, Agent, or Firm* — Oblon, McClelland, Maier & Neustadt, L.L.P.

(57) ABSTRACT

An exhaust hood in an embodiment includes: an outer casing; and an annular diffuser which is provided on a downstream side of a final turbine stage and formed by a cylindrical steam guide and a cylindrical bearing cone provided inside the steam guide. The steam guide includes a curved guide and a flat-plate guide which is provided on a downstream side of the curved guide. When a cross section of the outer casing vertical to the rotation axis of the turbine rotor is viewed from the downstream side of the steam guide, expansion outward in the radial direction of the flat-plate guide is set based on D/H where a distance between the rotation axis of the turbine rotor and an inner surface of the outer casing is H and a distance between the rotation axis of the turbine rotor and a downstream end of the flat-plate guide is D.

6 Claims, 8 Drawing Sheets

(56) References Cited

U.S. PATENT DOCUMENTS

| | | | | |
|---|---|---|---|---|
| 5,518,366 | A * | 5/1996 | Gray | F01D 25/30 415/211.2 |
| 6,261,055 | B1 * | 7/2001 | Owczarek | F01D 1/02 415/148 |
| 6,447,247 | B1 | 9/2002 | Geiger | |
| 8,221,053 | B2 * | 7/2012 | Predmore | F01D 25/26 415/108 |
| 8,439,633 | B2 * | 5/2013 | Mundra | F01D 1/00 415/169.1 |
| 9,033,656 | B2 * | 5/2015 | Mizumi | F01D 25/30 415/207 |
| 2009/0263241 | A1 * | 10/2009 | Demiraydin | F01D 25/30 415/207 |
| 2012/0183397 | A1 | 7/2012 | Mizumi et al. | |
| 2013/0224006 | A1 * | 8/2013 | Saeki | F01D 1/04 415/207 |
| 2014/0047813 | A1 * | 2/2014 | Frailich | F01D 25/30 60/39.5 |
| 2015/0240667 | A1 * | 8/2015 | Nanda | F01D 25/30 60/39.182 |

FOREIGN PATENT DOCUMENTS

| | | | |
|---|---|---|---|
| JP | 3776580 | B2 * | 5/2006 |
| JP | 4249903 | | 4/2009 |
| JP | 2012-145081 | A | 8/2012 |
| JP | 2013-174160 | A | 9/2013 |
| JP | 5499348 | | 5/2014 |

* cited by examiner

TURBINE EXHAUST HOOD

CROSS REFERENCE TO RELATED APPLICATIONS

This application is based upon and claims the benefit of priority from Japanese Patent Application No. 2017-005879, filed on Jan. 17, 2017; the entire contents of which are incorporated herein by reference.

FIELD

Embodiments described herein relate generally to a turbine exhaust hood.

BACKGROUND

From the viewpoints of effective use of energy resources and the like, an axial flow turbine used for power generation is required to be improved in turbine performance.

One important factor for improving the turbine performance can be a decrease in pressure loss of a working fluid passing through a turbine stage at a final stage (hereinafter, referred to as a final turbine stage). An example of the pressure loss occurring in the working fluid passing through the final turbine stage is a turbine exhaust loss. The turbine exhaust loss is the pressure loss of the working fluid occurring between an outlet of the final turbine stage and an outlet of an exhaust hood.

The turbine exhaust loss varies depending on the velocity of the working fluid at the outlet of the final turbine stage. The velocity of the working fluid at the outlet of the final turbine stage varies depending on operating conditions of a power generation plant, a tip outside diameter and a blade length of rotor blades at the final turbine stage. Therefore, a structure which can decrease the turbine exhaust loss regardless of the operating conditions and the structural conditions such as the tip outside diameter and the blade length of the rotor blades, is required.

A certain axial flow turbine includes, as the exhaust hood: an annular diffuser which is formed by a cylindrical guide and a cylindrical cone provided inside the guide, and discharges the working fluid passing through the final turbine stage outward in the radial direction; and an exhaust flow path through which the working fluid discharged from the annular diffuser flows.

The annular diffuser sufficiently decreases the velocity of the working fluid discharged from the final turbine stage to restore the static pressure. The exhaust flow path is a flow path that guides the working fluid discharged from the annular diffuser to the outlet of the exhaust hood. This exhaust flow path is required to decrease the pressure loss due to stirring, a vortex flow or the like of the working fluid.

For example, in an axial flow turbine of a downward exhaust type, the working fluid discharged from the annular diffuser on an upper half side flows along an inner surface of an outer casing and is thereby turned downward, and flows toward the outlet of the exhaust hood therebelow. Further, in the exhaust flow path, the flow of the working fluid toward the outlet of the exhaust hood therebelow joins with the flow of the working fluid discharged from the annular diffuser on a lower half side.

In the axial flow turbine of the downward exhaust type, it is discussed to decrease the pressure loss of the working fluid in the exhaust flow path by decreasing the pressure loss when the flow of the working fluid discharged from the annular diffuser on the upper half side and heading toward the outlet of the exhaust hood therebelow and the flow of the working fluid discharged from the annular diffuser on the lower half side join together.

It is also discussed to deform the curvature of a guide in the annular diffuser in a circumferential direction to suppress separation of the working fluid in the annular diffuser so as to decrease the pressure loss of the working fluid in the annular diffuser.

For the exhaust hood of the above-described conventional axial flow turbine, the annular diffuser and the outer casing are designed based on predetermined operating conditions and predetermined structural conditions. Therefore, when the operating conditions and the structural conditions such as the tip outside diameter and the blade length of the rotor blades are changed, it is difficult to optimally decrease the pressure loss of the working fluid.

Further, in the exhaust hood of the conventional axial flow turbine, the pressure loss may increase in the exhaust flow path on the upper half side depending on a flow path area of the outlet of the annular diffuser or the distance between the outlet of the annular diffuser and the inner surface of the outer casing.

DETAILED DESCRIPTION

In one embodiment, a working fluid flowing out of a turbine stage at a final stage of an axial flow turbine including a turbine rotor passes through a turbine exhaust hood. The turbine exhaust hood includes: a casing constituting the turbine exhaust hood; and an annular diffuser which is provided on a downstream side of the turbine stage at the final stage and formed by a cylindrical guide and a cylindrical cone provided inside the guide and discharges the working fluid passing through the turbine stage at the final stage, outward in a radial direction.

Further, the guide includes a curved guide which is curved outward in the radial direction as going downstream, and a flat-plate guide which is provided on a downstream side of the curved guide and vertical to a direction of a rotation axis of the turbine rotor and expands outward in the radial direction.

Further, when a cross section of the casing vertical to the rotation axis of the turbine rotor is viewed from the downstream side of the guide, expansion outward in the radial direction of the flat-plate guide is set based on D/H where a distance between the rotation axis of the turbine rotor and an inner surface of the casing is H and a distance between the rotation axis of the turbine rotor and a downstream end of the flat-plate guide is D.

First Embodiment

Figure 1:
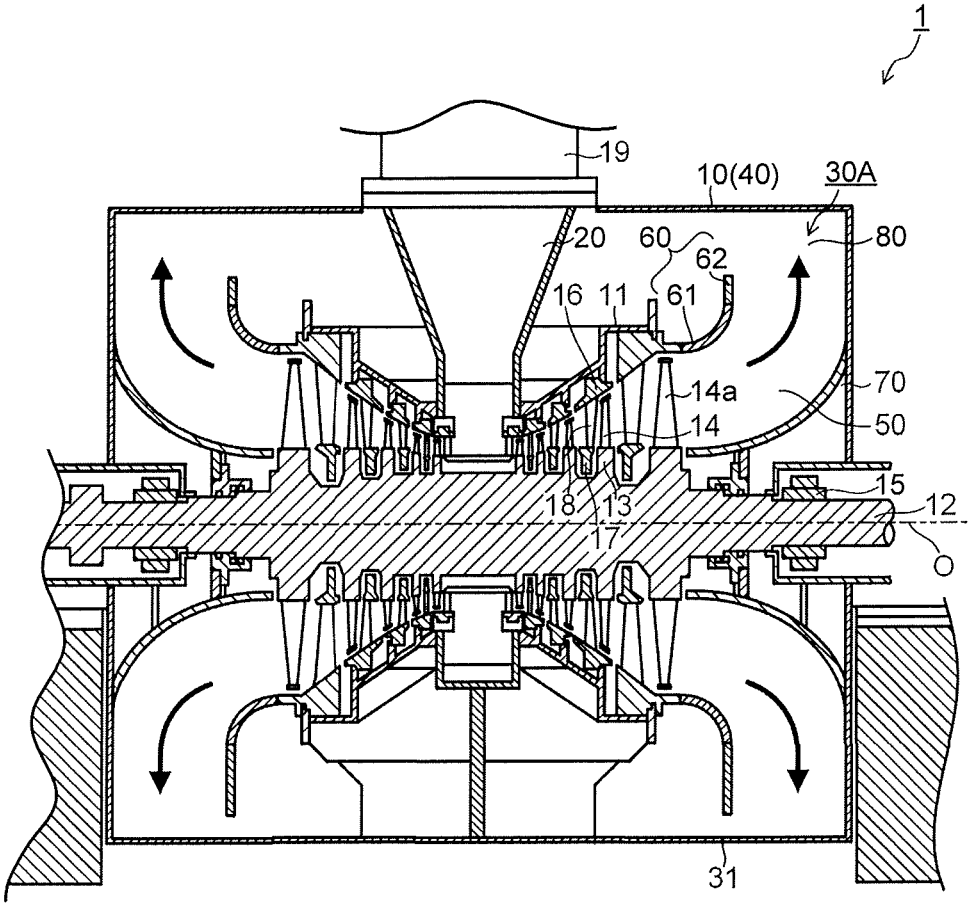
FIG. 1 is view illustrating a meridian cross section in a vertical direction of a steam turbine including an exhaust hood in a first embodiment.

FIG. 1 is a view illustrating a meridian cross section in a vertical direction of a steam turbine 1 including an exhaust hood 30A in a first embodiment. Note that the steam turbine is exemplified here as an axial flow turbine. Besides, as the steam turbine, a low-pressure turbine of a double-flow exhaust type including an exhaust hood of a downward exhaust type is exemplified and described. Therefore, a working fluid is steam in the following embodiment.

As illustrated in FIG. 1, an inner casing 11 is provided in an outer casing 10 in the steam turbine 1. In the inner casing 11, a turbine rotor 12 is provided therethrough. The turbine rotor 12 is formed with a rotor disk 13 projecting outward in a radial direction over a circumferential direction. The rotor disk 13 is formed at a plurality of stages in a direction of the rotation axis of the turbine rotor 12.

On the rotor disk 13 of the turbine rotor 12, a plurality of rotor blades 14 are implanted in the circumferential direction to constitute a rotor blade cascade. The rotor blade cascade is provided at a plurality of stages in the direction of the rotation axis of the turbine rotor 12. The turbine rotor 12 is supported to be rotatable by a rotor bearing 15.

Inside the inner casing 11, a diaphragm outer ring 16 and a diaphragm inner ring 17 are provided. Between the diaphragm outer ring 16 and the diaphragm inner ring 17, a plurality of stationary blades 18 are arranged in the circumferential direction to constitute a stationary blade cascade.

This stationary blade cascade is arranged to be alternate with the rotor blade cascade in the direction of the rotation axis of the turbine rotor 12. The stationary blade cascade and the rotor blade cascade lying immediately downstream from the stationary blade cascade constitute one turbine stage. Note that the rotor blades provided at a turbine stage at a final stage (hereinafter, referred to as a final turbine stage) are illustrated as final stage rotor blades 14*a*. The final turbine stage is a final turbine stage through which steam passes before flowing into the exhaust hood.

At the center of the steam turbine 1, an intake chamber 20 is provided into which steam is introduced from a crossover pipe 19. The steam is distributed and introduced from the intake chamber 20 into right and left turbine stages.

Next, the exhaust hood 30A into which the steam passing through the final turbine stage flows will be described. This exhaust hood 30A functions as a turbine exhaust hood.

Figure 2:
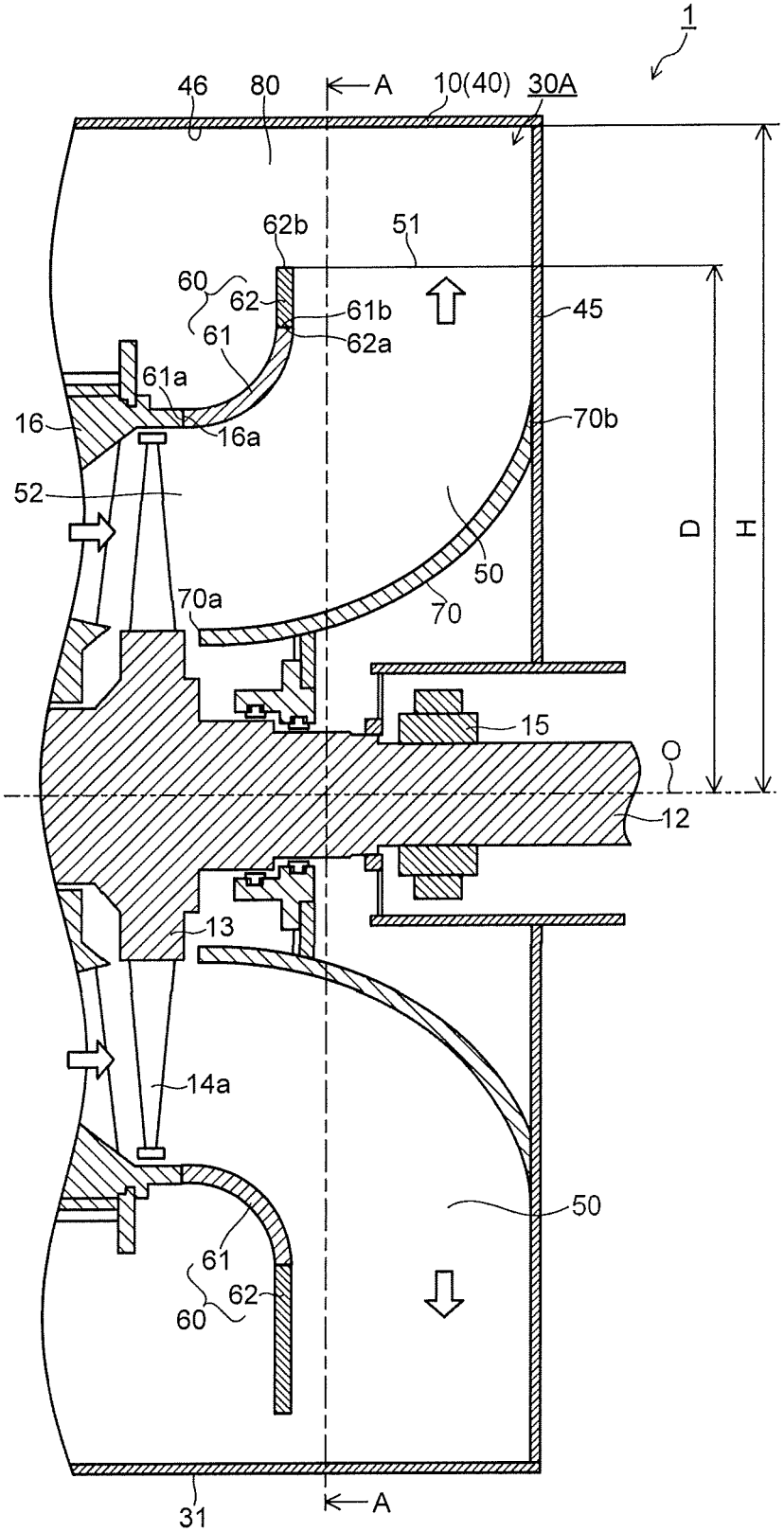
FIG. 2 is a view illustrating a meridian cross section in the vertical direction of the exhaust hood in the first embodiment.
Figure 3:
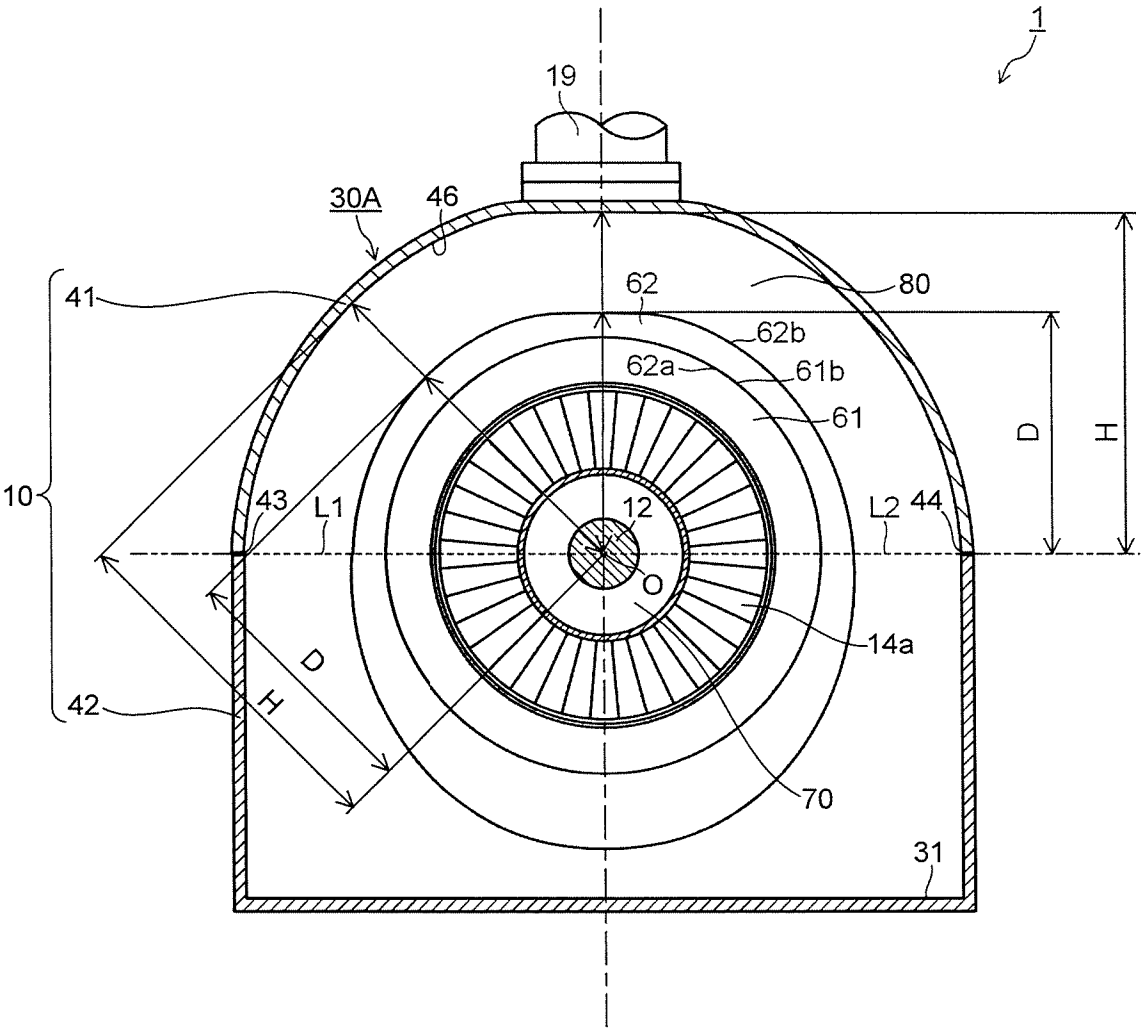
FIG. 3 is a cross-sectional view illustrating a cross section taken along A-A in FIG. 2.

FIG. 2 is a view illustrating a meridian cross section in the vertical direction of the exhaust hood 30A in the first embodiment. FIG. 3 is a cross-sectional view illustrating a cross section taken along A-A in FIG. 2. FIG. 3 is a cross-sectional view of the cross section of the exhaust hood 30A vertical to a rotation axis O of the turbine rotor 12 when viewed from a downstream side of a steam guide 60. Note that FIG. 3 illustrates the configuration with a part thereof omitted for convenience.

The exhaust hood 30A includes, as illustrated in FIG. 2, a casing 40 constituting a shell of the exhaust hood 30A. Note that the casing 40 functions here also as the outer casing 10 of the steam turbine 1 illustrated in FIG. 1. Hence, the casing 40 is described as the outer casing 10 below.

The outer casing 10 constituting the shell of the exhaust hood 30A includes an arc-shaped casing 41 curved in a shape of protruding outward and a box-shaped casing 42 connected to the arc-shaped casing 41 in the cross section illustrated in FIG. 3. The arc-shaped casing 41 is curved in a shape of protruding upward here. Further, the box-shaped casing 42 is connected to the lower part of the arc-shaped casing 41 here.

Note that in the cross section illustrated in FIG. 3, the arc-shaped casing 41 is not limited to an arc centering on the rotation axis O of the turbine rotor 12. The arc-shaped casing 41 may have a part in a linear shape as illustrated in FIG. 3.

Here, connection portions between the arc-shaped casing 41 and the box-shaped casing 42 are connection points 43, 44 in the cross section illustrated in FIG. 3.

The cross-sectional shape of the arc-shaped casing 41 is an arc shape curved in a shape of protruding outward. The arc-shaped casing 41 is made of a form made by extending the cross-sectional shape along the rotation axis O of the turbine rotor 12.

The cross-sectional shape of the box-shaped casing 42 is a rectangular shape. The box-shaped casing 42 is made of a form made by extending the cross-sectional shape along the rotation axis O of the turbine rotor 12. In the cross section illustrated in FIG. 3, two side walls of the box-shaped casing 42 linearly extend. The box constituting the box-shaped casing 42 is in a shape of a box body such as a rectangular parallelepiped or a regular hexahedron having a pair of opposing faces opened.

Note that in the arc-shaped casing 41 and the box-shaped casing 42, both ends in the direction of the rotation axis of the turbine rotor 12 are closed by wall portions.

In the cross section illustrated in FIG. 3, a virtual straight line L1 linking the connection point 43 and the rotation axis O and a virtual straight line L2 linking the connection point 44 and the rotation axis O are located on the same straight line passing through the rotation axis O. Further, the virtual straight line L1 and the virtual straight line L2 are located on a horizontal straight line passing through the rotation axis O.

Note that the connection point 43 and the connection point 44 are end points on the inner face side (the inner face side of the outer casing 10) of a joint portion between the arc-shaped casing 41 and the box-shaped casing 42.

Therefore, a straight line composed of the virtual straight line L1 and the virtual straight line L2 is a so-called boundary between an upper half side and a lower half side. Note that, generally, the upper side of the horizontal straight line passing through the rotation axis O of the turbine rotor 12 is called the upper half side, and the lower side with respect to the horizontal straight line passing through the rotation axis O of the turbine rotor 12 is called the lower half side.

In other words, in the configuration illustrated in FIG. 3, the arc-shaped casing 41 side (the upper side) including the straight line composed of the virtual straight line L1 and the virtual straight line L2 corresponds to the upper half side. Besides, the box-shaped casing 42 side (the lower side) with respect to the straight line composed of the virtual straight line L1 and the virtual straight line L2 corresponds to the lower half side.

Hence, in the first embodiment, the arc-shaped casing 41 side (the upper side) including the straight line composed of the virtual straight line L1 and the virtual straight line L2 is called the upper half side, and the box-shaped casing 42 side (the lower side) with respect to the straight line composed of the virtual straight line L1 and the virtual straight line L2 is called the lower half side.

The exhaust hood 30A includes, as illustrated in FIG. 2, an annular diffuser 50 into which the steam passing through the final turbine stage flows, and an exhaust flow path 80 which guides the steam discharged from the annular diffuser 50 to an outlet 31 of the exhaust hood 30A. Note that the outlet 31 of the exhaust hood 30A is opened, for example, by a plurality of opening portions.

The annular diffuser 50 discharges the steam passing through the final turbine stage, outward in the radial direction. The annular diffuser 50 is an annular path formed by the cylindrical steam guide 60 and a cylindrical bearing cone 70 provided inside the steam guide 60. In other words, the annular diffuser 50 is an annular flow path formed between the steam guide 60 and the bearing cone 70. Note that the steam guide 60 functions as a guide, and the bearing cone 70 functions as a cone.

An upstream end 70*a* of the bearing cone 70 is located on a slightly downstream side of the rotor disk 13 on which the final stage rotor blades 14*a* are implanted. The bearing cone 70 is curved outward in the radial direction as it goes downstream. In other words, the bearing cone 70 is configured in an enlarging cylindrical shape expanding in a bugle shape toward the downstream side. A downstream end 70*b* of the bearing cone 70 is in contact with a downstream wall 45 of the outer casing 10. Note that in the bearing cone 70, for example, a rotor bearing 15 and the like are arranged.

The steam guide 60 includes a curved guide 61 and a flat-plate guide 62. An upstream end 61*a* of the curved guide 61 is connected to a downstream end 16*a* of the diaphragm outer ring 16 surrounding the final stage rotor blades 14*a*. The curved guide 61 is curved outward in the radial direction as it goes downstream. In other words, the curved guide 61 is configured in an enlarging cylindrical shape expanding in a bugle shape toward the downstream side.

In other words, the curved guide 61 expands in a bugle shape while expanding outward in the radial direction as it goes to a turbine exhaust direction and the direction of the rotation axis of the turbine rotor 12. The direction of expanding outward in the radial direction at the downstream end 61*b* of the curved guide 61 is a direction vertical to the rotation axis O of the turbine rotor 12.

The curved guide 61 has the same shape on the upper half side and the lower half side. More specifically, the curved guide 61 has the same shape over the circumferential direction. In other words, the curved guide 61 is a body of rotation obtained by rotating the cross section of the curved guide 61 illustrated on the upper half side in FIG. 2 using the rotation axis O of the turbine rotor 12 as a rotation axis.

An upstream end 62*a* of the flat-plate guide 62 is connected to the downstream end 61*b* of the curved guide 61. The flat-plate guide 62 is vertical to the direction of the rotation axis of the turbine rotor 12 and radially expands outward in the radial direction. The flat-plate guide 62 is a disk-shaped flat plate having a center cutout to open correspondingly to the outside diameter of the curved guide 61.

Here, the direction of expansion outward in the radial direction at the downstream end 61*b* of the curved guide 61 is a direction vertical to the rotation axis O of the turbine rotor 12. Therefore, the flat-plate guide 62 is continuously and smoothly connected to the curved guide 61. Thus, the steam smoothly flows without disturbance when the steam passes through the connection portion between the flat-plate guide 62 and the curved guide 61.

Further, since the flat-plate guide 62 is a disk-shaped flat plate, the flat-plate guide 62 and the curved guide 61 can be easily joined together by welding or the like.

Note that though a configuration that the flat-plate guide 62 and the curved guide 61 are produced as separate bodies and joined together is illustrated here, the flat-plate guide 62 and the curved guide 61 may be integrally produced.

The radial expansion outward in the radial direction of the flat-plate guide 62 is nonuniform in the circumferential direction with respect to the rotation axis O of the turbine rotor 12, for example, as illustrated in FIG. 3. For example, the outside diameter of the flat-plate guide 62 on the lower half side may be configured to be larger, in a range allowable in terms of structure, than the flat-plate guide 62 on the upper half side as illustrated in FIG. 3.

Note that to suppress the pressure loss of the flow of steam, the outside diameter of the flat-plate guide 62 on the lower half side preferably gradually increases from the outside diameter of the upper end portion on the lower half side coupled to the upper half side.

Figure 4:
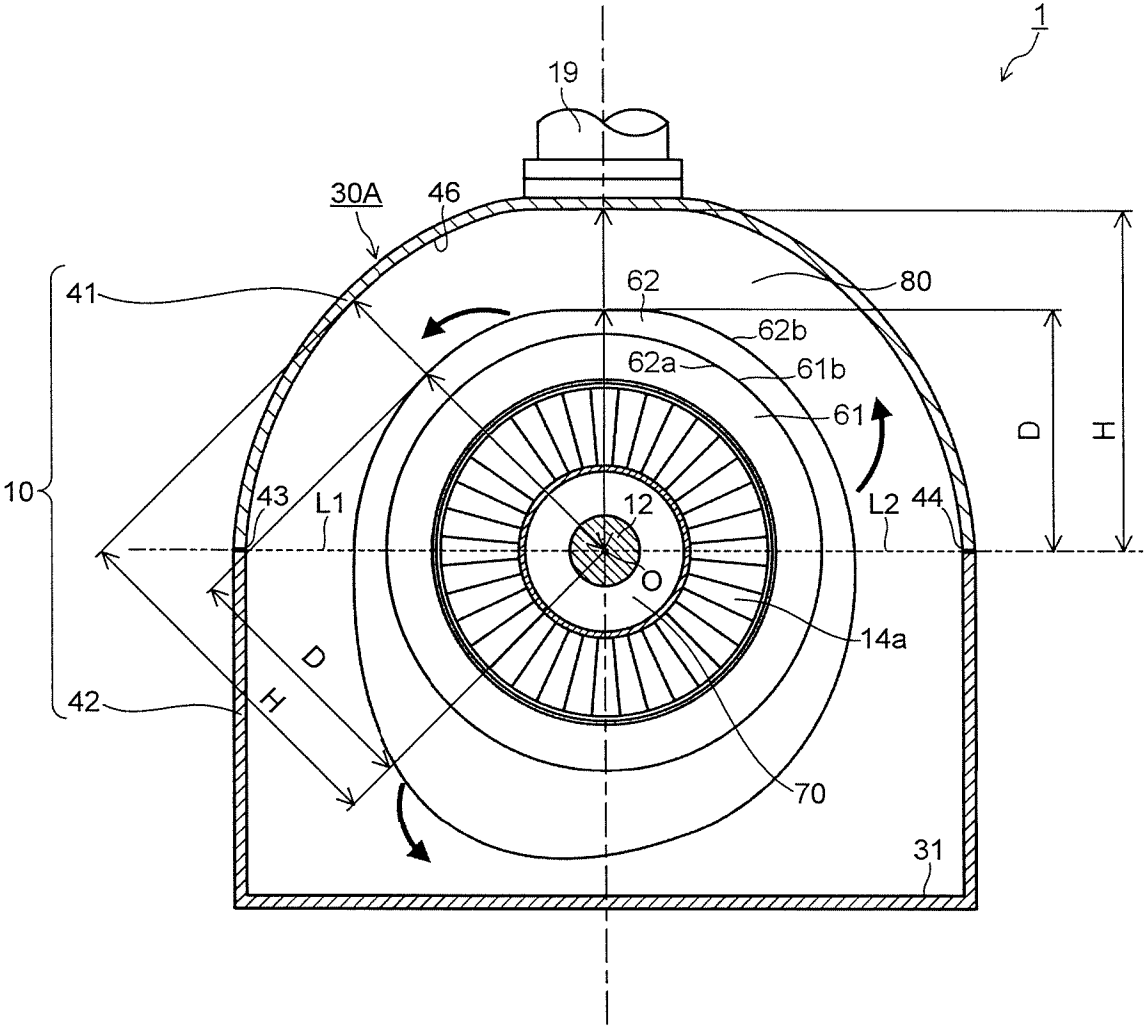
FIG. 4 is a cross-sectional view corresponding to the cross section taken along A-A in FIG. 2 and illustrates one example of a shape different from the shape of a flat-plate guide illustrated in FIG. 3.

Here, FIG. 4 is a cross-sectional view corresponding to the cross section taken along A-A in FIG. 2 and illustrates one example of a shape different from the shape of the flat-plate guide 62 illustrated in FIG. 3. Note that the flow of steam is indicated by arrows in FIG. 4.

The steam passing through the final turbine stage flows into the annular diffuser 50 while swirling clockwise or counterclockwise around the rotation axis O of the turbine rotor 12. In this event, deviation occurs in the flow velocity of the steam in the circumferential direction. In other words, deviation occurs in flow rate of the steam in the circumferential direction in the annular diffuser 50.

Hence, as illustrated in FIG. 4, the expansion outward in the radial direction of the flat-plate guide 62 in a region where the flow rate of the steam increases may be made larger in a range allowable in terms of structure. In other words, the outside diameter of the flat-plate guide 62 in the region where the flow rate of the steam increases may be made larger.

Since the flow of steam flowing into the annular diffuser 50 while swirling counterclockwise in the cross section in FIG. 4 is assumed in FIG. 4, the region where the flow rate of the steam increases exists on the left side on the lower half side. Therefore, the outside diameter of the flat-plate guide 62 in the region is made larger than the outside diameter of the flat-plate guide 62 in the other region on a lower half side.

Making the outside diameter of the flat-plate guide 62 on the lower half side larger is preferable for reducing the flow velocity of the steam in the annular diffuser 50 to restore the static pressure. For this reason, the outside diameter of the flat-plate guide 62 on the lower half side is preferably made larger in a range allowable in terms of structure.

Here, the flow of the steam on the upper half side will be described.

In the above-described flat-plate guide 62 on the lower half side, a straightening effect in the annular diffuser 50 can be obtained by making the outside diameter larger. On the other hand, on the upper half side, the steam discharged outward in the radial direction by the annular diffuser flows along an inner surface 46 of the outer casing 10, whereby its flow direction is turned, for example, by 180° to an opposite direction. Therefore, if the outside diameter of the flat-plate guide 62 on the upper half side is too large, the flow stagnates in a gap between an outlet 51 of the annular diffuser 50 and the inner surface 46 of the outer casing 10. This deteriorates the fluid performance near the outlet 51 of the annular diffuser 50.

For the above reason, on the upper half side, an optimal range for improving the fluid performance exists in the gap between the outlet 51 of the annular diffuser 50 and the inner surface 46 of the outer casing 10.

Hence, the present inventors investigated the influence of the gap between the outlet 51 of the annular diffuser 50 and the inner surface 46 of the outer casing 10 exerted on the fluid performance on the upper half side.

Here, as illustrated in FIG. 2 and FIG. 3, the distance between the rotation axis O of the turbine rotor 12 and the downstream end 62*b* of the flat-plate guide 62 on the upper half side is assumed to be D, and the distance between the rotation axis O of the turbine rotor 12 and the inner surface 46 of the outer casing 10 on the upper half side is assumed to be H.

Then, the optimal range of the gap between the outlet 51 of the annular diffuser 50 and the inner surface 46 of the outer casing 10 was evaluated using D/H as a parameter.

Here, D and H used for the parameter D/H are D and H in the same radial direction on the upper half side. More specifically, D and H in the case where the radial direction is the vertical direction and D and H in the case where the radial direction is a direction inclined counterclockwise from the vertical direction are exemplified in FIG. 3. In short, D and H used for the parameter D/H only need to be D and H on the upper half side and in the same radial direction.

Using D/H as the parameter as described above enables evaluation without depending on the operating conditions and the structural conditions such as a tip outside diameter and a blade length of the rotor blades at the final turbine stage.

Figure 5:
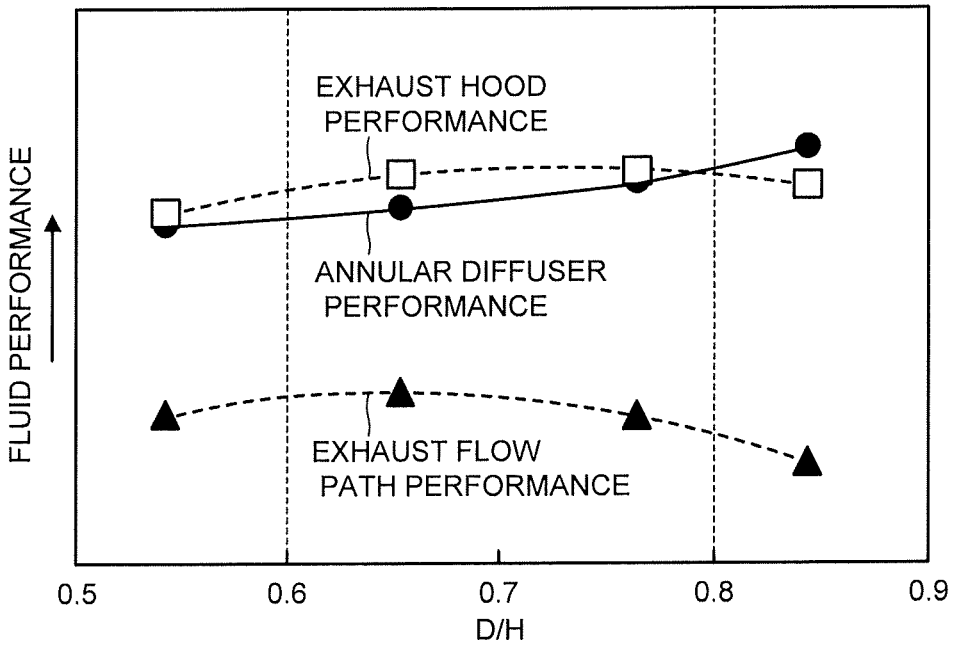
FIG. 5 is a chart illustrating a fluid performance with respect to D/H.

FIG. 5 is a chart illustrating the fluid performance with respect to D/H. FIG. 5 illustrates the fluid performance in the annular diffuser 50, the fluid performance in the exhaust flow path 80, and the fluid performance in the exhaust hood 30A.

The fluid performance in the annular diffuser 50 (annular diffuser performance) is a performance in consideration of the pressure loss occurring from an inlet 52 of the annular diffuser 50 to the outlet 51 of the annular diffuser 50. The fluid performance in the exhaust flow path 80 (exhaust flow path performance) is a performance in consideration of the pressure loss occurring from the outlet 51 of the annular diffuser 50 to the outlet 31 of the exhaust hood 30A. The fluid performance in the exhaust hood (exhaust hood performance) is a performance in consideration of the pressure loss occurring from the inlet 52 of the annular diffuser 50 to the outlet 31 of the exhaust hood 30A.

Here, the fluid performance in the whole exhaust hood 30A including the annular diffuser 50 and the exhaust flow path 80 is indicated by the exhaust hood performance. In FIG. 5, a larger value on the vertical axis means superior fluid performance.

Note that the fluid performances illustrated in FIG. 5 are results obtained by numerical analysis. Further, FIG. 5 illustrates results at assuming the time of the rated output of the steam turbine 1.

As illustrated in FIG. 5, the annular diffuser performance improves with an increase in D/H. On the other hand, regarding the exhaust flow path performance, high fluid performance is obtained in a range of $0.54 \leq D/H \leq 0.75$. Regarding the exhaust hood performance indicating the fluid performance in the whole exhaust hood 30A, high fluid performance is obtained in a range of $0.6 \leq D/H \leq 0.8$.

Note that though not illustrated, also in results at assuming the time of output lower than the rated output or the time of output higher than the rated output different in operating conditions, high exhaust hood performance can be obtained in the above-described range of D/H as in FIG. 5.

The above shows that it is optimal to set D/H on the upper half side to a range of 0.6 or more and 0.8 or less ($0.6 \leq D/H \leq 0.8$) in order to obtain the high exhaust hood performance. Hence, the exhaust hood 30A is configured to have a D/H of 0.6 or more and 0.8 or less on the upper half side.

Setting D/H on the upper half side to the above-described range makes it possible to make the outside diameter of the flat-plate guide 62 larger while keeping the gap between the outlet 51 of the annular diffuser 50 and the inner surface 46 of the outer casing 10 in an appropriate range. Making the outside diameter of the flat-plate guide 62 on the upper half side larger increases the flow path cross-sectional area at the outlet 51. Thus, the flow of the steam is decelerated to sufficiently restore the static pressure.

In other words, setting D/H on the upper half side to the above-described range makes it possible to obtain a sufficient straightening effect in the annular diffuser 50 while suppressing the decrease in fluid performance occurring in the gap between the outlet 51 of the annular diffuser 50 and the inner surface 46 of the outer casing 10.

The above-described annular diffuser 50 may be configured, for example, in a structure in which the annular diffuser 50 is divided into upper and lower halves. In this case, the annular diffuser 50 may have a structure in which the annular diffuser 50 is divided into an upper part and a lower part by a horizontal plane passing through the rotation axis O of the turbine rotor 12. Alternatively, the annular diffuser 50 may have a structure in which the annular diffuser 50 is divided into an upper part and a lower part, for example, by a horizontal plane not passing through the rotation axis O of the turbine rotor 12. In short, when the annular diffuser 50 is configured in the structure in which the annular diffuser 50 is divided into the upper and lower halves, the position of a division boundary between the upper part and the lower part is not particularly limited.

Here, the flow of the steam in the steam turbine 1 and the exhaust hood 30A will be described.

As illustrated in FIG. 1, the steam passing through the crossover pipe 19 and flowing into the intake chamber 20 in the steam turbine 1 flows branching off to right and left turbine stages. The steam then passes through the steam flow path including the stationary blades 18 and the rotor blades 14 at each turbine stage while performing expansion work to rotate the turbine rotor 12. The steam passing through the final turbine stage flows into the annular diffuser 50.

The steam flowing into the annular diffuser 50 flows toward the outlet 51 while its flow direction is being turned outward in the radial direction. In this event, the flow of the steam is decelerated to restore the static pressure. The steam then flows out from the outlet 51 outward in the radial direction into the exhaust flow path 80.

Here, the outside diameter of the flat-plate guide 62 on the upper half side is set to satisfy the above-described range of D/H in a range allowable in terms of structure. Therefore, while the decrease in fluid performance due to the fluid stirring, a vortex flow or the like occurring in the gap between the outlet 51 of the annular diffuser 50 and the inner surface 46 of the outer casing 10 is suppressed, a sufficient straightening effect can be obtained in the annular diffuser 50.

Besides, the outside diameter of the flat-plate guide 62 on the lower half side is larger than the outside diameter of the flat-plate guide 62 on the upper half side. Therefore, the flow path cross-sectional area at the outlet 51 on the lower half side is larger than the flow path cross-sectional area at the outlet 51 on the upper half side. Thus, the flow of the steam is sufficiently decelerated on the lower half side to restore the static pressure.

The flow direction of the steam flowing out from the outlet 51 of the annular diffuser 50 on the upper half side is turned downward. The steam whose flow direction is turned downward then flows toward the outlet 31 of the exhaust hood 30A.

The steam flowing out from the outlet 51 of the annular diffuser 50 on the lower half side flows toward the outlet 31 of the exhaust hood 30A.

Then, the flow of the steam from the upper half side and the flow of the steam flowing out from the outlet 51 of the annular diffuser 50 on the lower half side join together. In this event, the outside diameter of the flat-plate guide 62 on the lower half side is large, and therefore the region where the steam flows joining together with the steam flowing from the upper half side is small. Further, since the respective flows are sufficiently decelerated at a joint part of the flows, the pressure loss due to the joining is decreased.

The joined steam is then discharged from the outlet 31, for example, into a steam condenser (not illustrated).

As described above, according to the exhaust hood 30A in the first embodiment, the expansion outward in the radial direction of the flat-plate guide 62 can be made nonuniform in the circumferential direction with respect to the rotation axis O of the turbine rotor 12, when the cross section of the exhaust hood 30A vertical to the rotation axis O of the turbine rotor 12 is viewed from the downstream side of the steam guide 60 as illustrated, for example, in FIG. 3. For example, the expansion outward in the radial direction of the flat-plate guide 62 in the region where the flow rate of the steam increases can be made larger. This increases the flow path cross-sectional area at the outlet 51 of the annular diffuser 50. Therefore, the flow velocity of the steam can be surely decreased in the annular diffuser 50 to restore the static pressure.

Further, setting D/H on the upper half side to the above-described range makes it possible to obtain a sufficient straightening effect in the annular diffuser 50 while suppressing the decrease in fluid performance occurring in the gap between the outlet 51 of the annular diffuser 50 and the inner surface 46 of the outer casing 10.

Further, according to the exhaust hood 30A in the first embodiment, the curved guide 61 can be made the same shape over the circumferential direction, and the expansion outward in the radial direction can be adjusted by the flat-plate guide 62. In the case where the curved guide 61 and the flat-plate guide 62 are produced as separate bodies and joined together as described above, the steam guide 60 can be easily produced.

Second Embodiment

Figure 6:
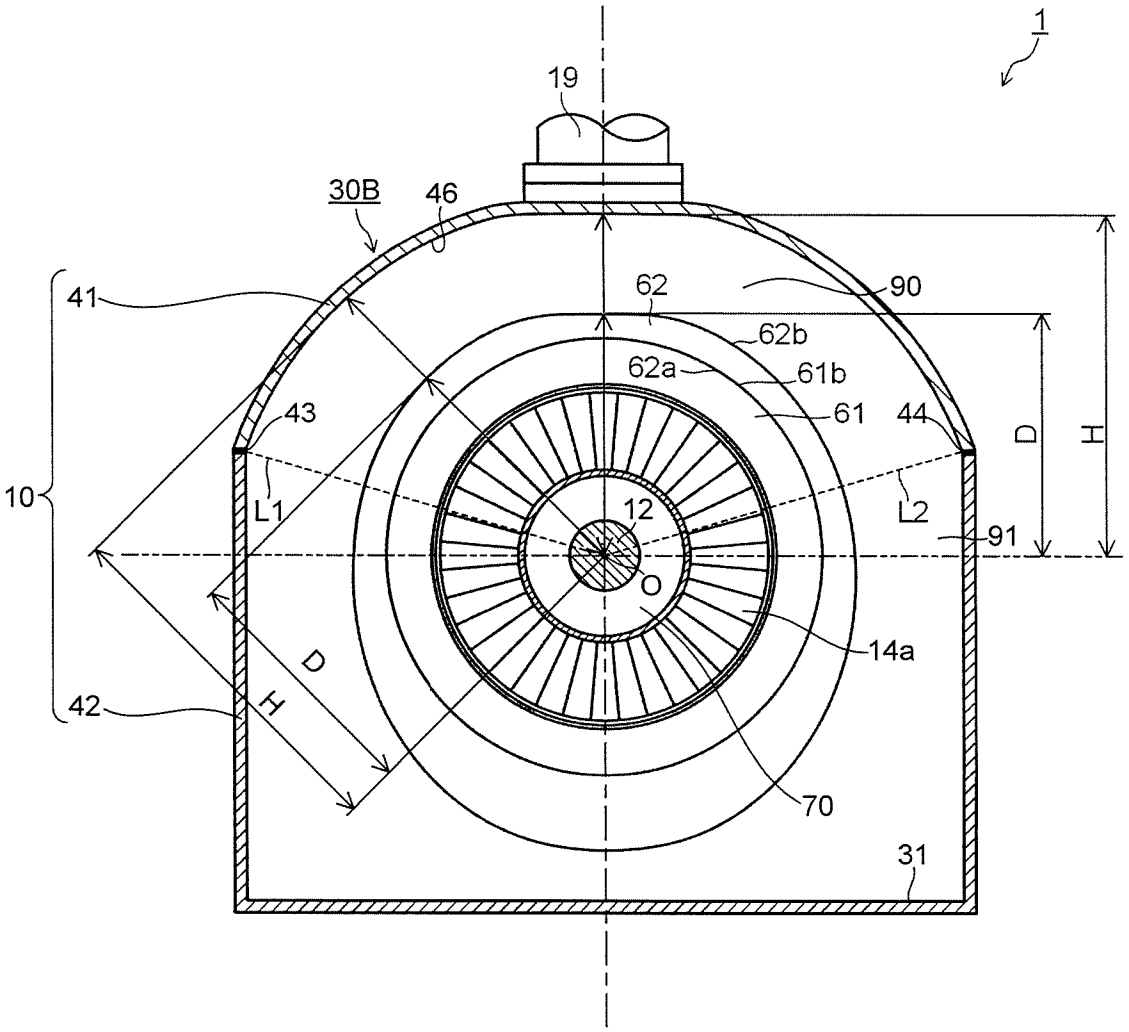
FIG. 6 is a cross-sectional view of an exhaust hood in a second embodiment, corresponding to the cross section taken along A-A in FIG. 2.

FIG. 6 is a cross-sectional view of an exhaust hood 30B in a second embodiment, corresponding to the cross section taken along A-A in FIG. 2. In other words, FIG. 6 is a cross-sectional view of the cross section of the exhaust hood 30B vertical to a rotation axis O of a turbine rotor 12 when viewed from a downstream side of a steam guide 60.

Note that FIG. 6 illustrates the configuration with a part thereof omitted for convenience. Further, in the following embodiment, portions having the same configurations as the configurations of the exhaust hood 30A in the first embodiment are denoted by the same signs to omit or simplify duplicated description.

A virtual straight line L1 linking a connection point 43 and the rotation axis O and a virtual straight line L2 linking a connection point 44 and the rotation axis O in the exhaust hood 30B in the second embodiment are not located on the same straight line, unlike the virtual straight lines L1, L2 in the exhaust hood 30A in the first embodiment. Therefore, the different configuration will be mainly described here.

As illustrated in FIG. 6, the connection points 43, 44 between an arc-shaped casing 41 and a box-shaped casing 42 are located on the arc-shaped casing 41 side with respect to the horizontal straight line passing through the rotation axis O. The connection points 43, 44 here are located on the upper side with respect to the horizontal straight line passing through the rotation axis O.

Therefore, in the cross section illustrated in FIG. 6, the virtual straight line L1 and the virtual straight line L2 extend inclined to the arc-shaped casing 41 side from the rotation axis O of the turbine rotor 12. In other words, the virtual straight line L1 is a straight line made by rotating the horizontal straight line extending from the rotation axis O to the connection point 43 side (left side in FIG. 6) by a predetermined angle clockwise around the rotation axis O. The virtual straight line L2 is a straight line made by rotating the horizontal straight line extending from the rotation axis O to the connection point 44 side (right side in FIG. 6) by a predetermined angle counterclockwise around the rotation axis O.

Also in this case, the exhaust hood 30B is configured to satisfy the relation of D/H illustrated in the first embodiment on the arc-shaped casing 41 side including the virtual straight line L1 and the virtual straight line L2. In other words, the exhaust hood 30B is configured such that a region 90 on the arc-shaped casing 41 side (upper side) including the virtual straight line L1 and the virtual straight line L2 satisfies the relation of D/H illustrated in the first embodiment in a range allowable in terms of structure.

Further, the outside diameter of the flat-plate guide 62 is configured to be larger in a region 91 on the box-shaped casing 42 side (lower side) with respect to the virtual straight line L1 and the virtual straight line L2, than in the region 90.

As described above, in the exhaust hood 30B in the second embodiment, the same operation and effect as those in the first embodiment can be obtained even when the connection points 43, 44 are located on the arc-shaped casing 41 side (upper side) with respect to the horizontal straight line passing through the rotation axis O. In other words, the exhaust hood 30B satisfying the above-described relation of D/H can obtain a sufficient straightening effect in the annular diffuser 50 while suppressing the decrease in fluid performance occurring in the gap between the outlet 51 of the annular diffuser 50 and the inner surface 46 of the outer casing 10.

Further, according to the exhaust hood 30B in the second embodiment, as illustrated in FIG. 6, the expansion outward in the radial direction of the flat-plate guide 62 can be made nonuniform in the circumferential direction with respect to the rotation axis O of the turbine rotor 12, when the cross section of the exhaust hood 30B vertical to the rotation axis O of the turbine rotor 12 is viewed from the downstream side of the steam guide 60. The operation and effect obtained by including this configuration are the same as the operation and effect in the first embodiment.

Third Embodiment

Figure 7:
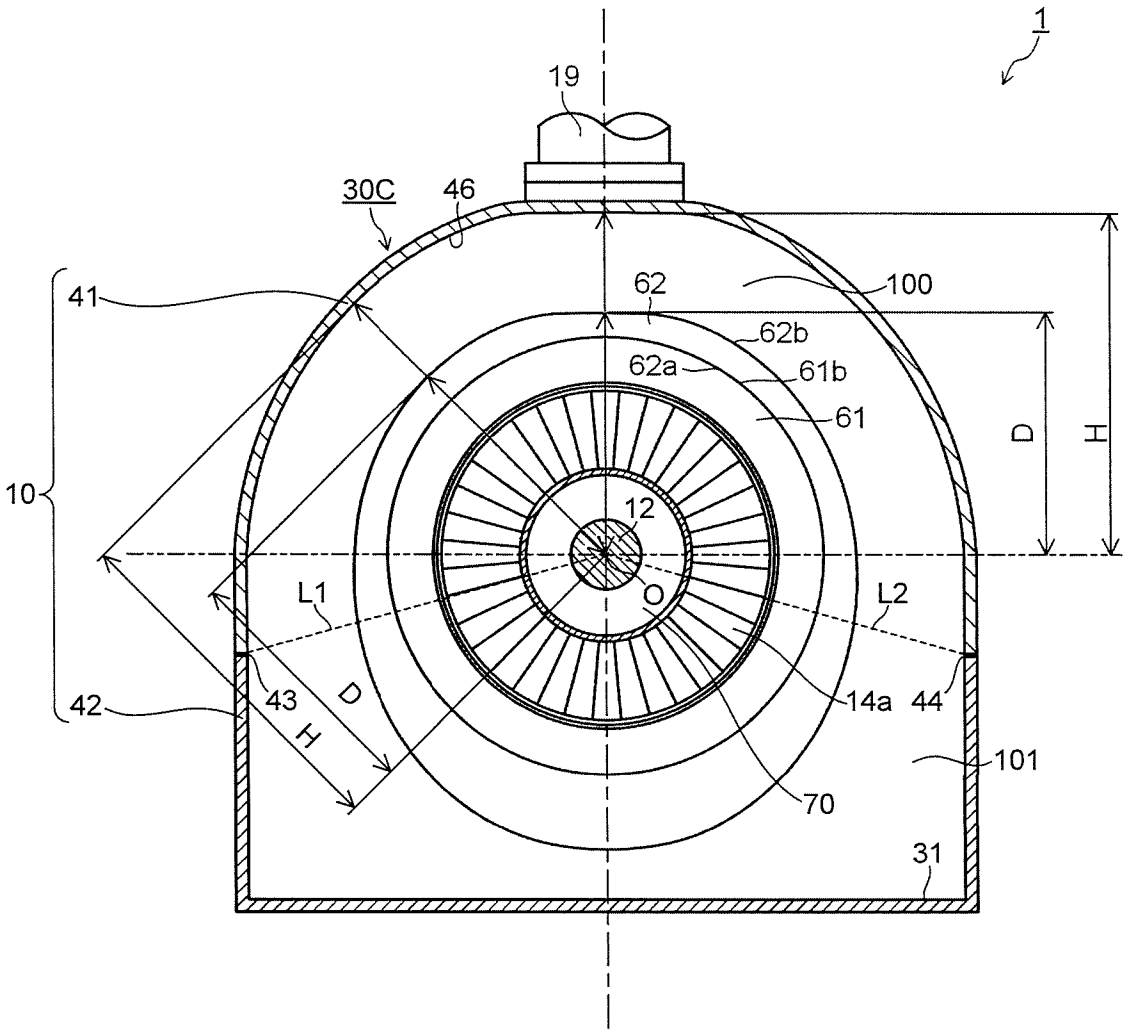
FIG. 7 is a cross-sectional view of an exhaust hood in a third embodiment, corresponding to the cross section taken along A-A in FIG. 2.

FIG. 7 is a cross-sectional view of an exhaust hood 30C in a third embodiment, corresponding to the cross section taken along A-A in FIG. 2. In other words, FIG. 7 is a cross-sectional view of the cross section of the exhaust hood 30C vertical to a rotation axis O of a turbine rotor 12 when viewed from a downstream side of a steam guide 60. Note that FIG. 7 illustrates the configuration with a part thereof omitted for convenience.

A virtual straight line L1 linking a connection point 43 and the rotation axis O and a virtual straight line L2 linking a connection point 44 and the rotation axis O in the exhaust hood 30C in the third embodiment are not located on the same straight line, unlike the virtual straight lines L1, L2 in the exhaust hood 30A in the first embodiment. Therefore, the different configuration will be mainly described here.

As illustrated in FIG. 7, the connection points 43, 44 between an arc-shaped casing 41 and a box-shaped casing 42 are located on the box-shaped casing 42 side with respect to the horizontal straight line passing through the rotation axis O. The connection points 43, 44 here are located on the lower side with respect to the horizontal straight line passing through the rotation axis O.

Therefore, in the cross section illustrated in FIG. 7, the virtual straight line L1 and the virtual straight line L2 extend inclined to the box-shaped casing 42 side from the rotation axis O of the turbine rotor 12. In other words, the virtual straight line L1 is a straight line made by rotating the horizontal straight line extending from the rotation axis O to the connection point 43 side (left side in FIG. 7) by a predetermined angle counterclockwise around the rotation axis O. The virtual straight line L2 is a straight line made by rotating the horizontal straight line extending from the rotation axis O to the connection point 44 side (right side in FIG. 7) by a predetermined angle clockwise around the rotation axis O.

Also in this case, the exhaust hood 30C is configured to satisfy the relation of D/H illustrated in the first embodiment on the arc-shaped casing 41 side including the virtual straight line L1 and the virtual straight line L2. In other words, the exhaust hood 30C is configured such that a region 100 on the arc-shaped casing 41 side (upper side) including the virtual straight line L1 and the virtual straight line L2 satisfies the relation of D/H illustrated in the first embodiment in a range allowable in terms of structure.

Further, the outside diameter of the flat-plate guide 62 is configured to be larger in a region 101 on the box-shaped casing 42 side (lower side) with respect to the virtual straight line L1 and the virtual straight line L2, than in the region 100.

As described above, in the exhaust hood 30C in the third embodiment, the same operation and effect as those in the first embodiment can be obtained even when the connection points 43, 44 are located on the box-shaped casing 42 side (lower side) with respect to the horizontal straight line passing through the rotation axis O. In other words, the exhaust hood 30C satisfying the above-described relation of D/H can obtain a sufficient straightening effect in the annular diffuser 50 while suppressing the decrease in fluid performance occurring in the gap between the outlet 51 of the annular diffuser 50 and the inner surface 46 of the outer casing 10.

Further, according to the exhaust hood 30C in the third embodiment, as illustrated in FIG. 7, the expansion outward in the radial direction of the flat-plate guide 62 can be made nonuniform in the circumferential direction with respect to the rotation axis O of the turbine rotor 12, when the cross section of the exhaust hood 30C vertical to the rotation axis O of the turbine rotor 12 is viewed from the downstream side of the steam guide 60. The operation and effect obtained by including this configuration are the same as the operation and effect in the first embodiment.

Fourth Embodiment

Though the exhaust hoods 30A, 30B, 30C each including the outlet 31 at a vertically lower portion are illustrated in the above-described first to third embodiments, the outlet 31 is not limited to this position.

Figure 8:
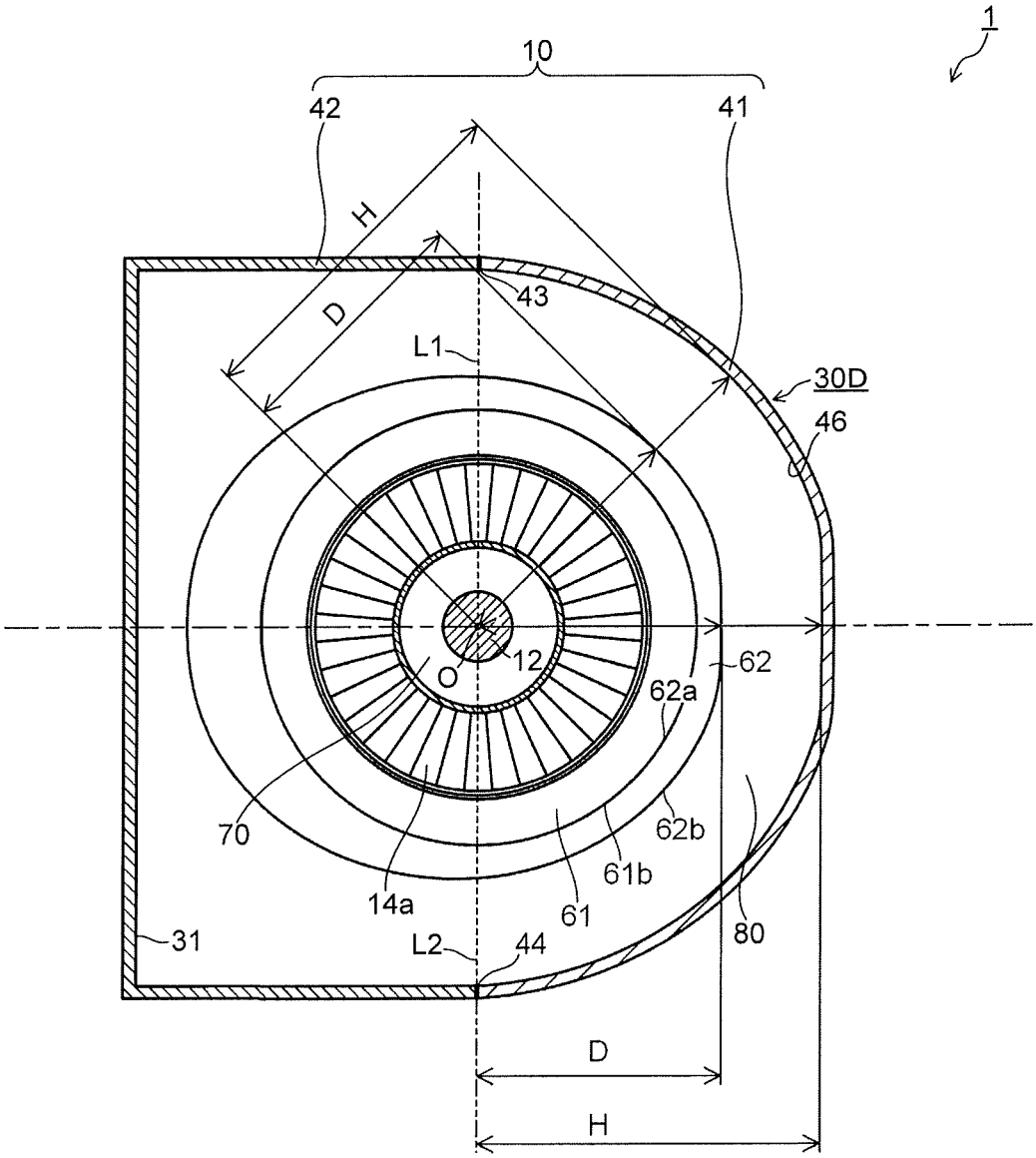
FIG. 8 is a cross-sectional view of an exhaust hood in a fourth embodiment, when the cross section of the exhaust hood vertical to a rotation axis of a turbine rotor is viewed from a downstream side of a steam guide.

FIG. 8 is a cross-sectional view of an exhaust hood 30D in a fourth embodiment, when the cross section of the exhaust hood 30D vertical to a rotation axis O of a turbine rotor 12 is viewed from a downstream side of a steam guide 60. Note that the exhaust hood 30D illustrated in FIG. 8 is a configuration made by rotating the cross section of the exhaust hood 30A illustrated in FIG. 3 by 90° clockwise around the rotation axis O.

As illustrated in FIG. 8, an outlet 31 of the exhaust hood 30D may be provided on a side portion side. In other words, the configuration of the exhaust hood in this embodiment is applicable not only to the steam turbine of the downward exhaust type but also to a steam turbine of a lateral exhaust type.

The exhaust hood 30D is also configured to satisfy the relation of D/H illustrated in the first embodiment in a range allowable in terms of structure on an arc-shaped casing 41 side including a virtual straight line L1 and a virtual straight line L2. In the exhaust hood 30D in the fourth embodiment, the same operation and effect as those in the first embodiment can be obtained.

Note that though the configuration made by rotating the cross section of the exhaust hood 30A illustrated in FIG. 3 by 90° clockwise around the rotation axis O is illustrated as the exhaust hood 30D here, the exhaust hood 30D may have a configuration made by rotating the cross section of the exhaust hood 30B illustrated in FIG. 6 or the cross section of the exhaust hood 30C illustrated in FIG. 7 by 90° clockwise around the rotation axis O. Also in these cases, the same operation and effect as those in the first embodiment can be obtained.

The above-described configurations of the exhaust hoods 30A, 30B, 30C, 30D in the embodiments are applicable not only to the exhaust hood of the steam turbine at low pressure but also to the exhaust hood of a steam turbine at high pressure or intermediate pressure.

According to the above-described embodiments, the pressure loss of the working fluid in the exhaust hood can be suppressed to reduce the turbine exhaust loss.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for designing a turbine exhaust hood of a low-pressure turbine through which a working fluid flowing out of a turbine stage at a final stage of an axial flow turbine including a turbine rotor passes, the method comprising:

constituting the turbine exhaust hood by a casing;

providing an annular diffuser on a first downstream side of the turbine stage at the final stage, the annular diffuser being formed by a cylindrical guide and a cylindrical cone provided inside the cylindrical guide to discharge the working fluid passing through rotor blades of the turbine stage at the final stage outward in a radial direction, the cylindrical guide having a curved guide and a flat-plate guide provided on a second downstream side of the curved guide and vertical to a direction of a rotation axis of the turbine rotor, the curved guide being curved outward in the radial direction as going downstream, the flat-plate guide expanding outward in the radial direction;

when a cross section of the casing vertical to the rotation axis of the turbine rotor is viewed from the downstream side of the cylindrical guide, setting expansion outward in the radial direction of the flat-plate guide based on D/H such that setting the expansion outward in the radial direction of the flat-plate guide based on D/H is independent of the operating conditions and the blade length of the rotor blades at the final turbine stage where a first distance between the rotation axis of the turbine rotor and an inner surface of the casing is H and a second distance between the rotation axis of the turbine rotor and a downstream end of the flat-plate guide is D, and the D/H satisfies a following relational expression in a same radial direction:

$$0.6 \leq D/H \leq 0.8.$$

2. The method according to claim 1, further comprising:

including in the casing, an arc-shaped casing curved in a shape of protruding outward, and a box-shaped casing connected to the arc-shaped casing; and on an arc-shaped casing side including two virtual straight lines each linking each of two connection points between the arc-shaped casing and the box-shaped casing and the rotation axis of the turbine rotor, the H being the first distance between the rotation axis of the turbine rotor and the inner surface of the arc-shaped casing.

3. The method according to claim 2, further comprising:

locating the two virtual straight lines on a same straight line passing through the rotation axis of the turbine rotor.

4. The method according to claim 2, further comprising:

extending the two virtual straight lines inclined to the arc-shaped casing side from the rotation axis of the turbine rotor.

5. The method according to claim 2, further comprising:

extending the virtual straight lines inclined to a box-shaped casing side from the rotation axis of the turbine rotor.

6. The method according to claim 1, the expansion outward in the radial direction of the flat-plate guide is non-uniform in a circumferential direction with respect to the rotation axis of the turbine rotor.

* * * * *